United States Patent [19]

Erickson et al.

[11] 4,264,285

[45] Apr. 28, 1981

[54] DOWNHOLE CLEANER ASSEMBLY FOR CLEANSING LUBRICANT OF DOWNHOLE TURBO-MACHINES WITHIN WELLS

[75] Inventors: John W. Erickson, Huntington Beach; Harold L. Petrie, Sierra Madre, both of Calif.

[73] Assignee: Kobe, Inc., Huntington Park, Calif.

[21] Appl. No.: 4,566

[22] Filed: Jan. 18, 1979

[51] Int. Cl.[3] ..... F04B 17/00

[52] U.S. Cl. ..... 417/405; 417/329

[58] Field of Search ..... 417/88, 89, 405, 406, 417/407, 408, 329

[56] References Cited

U.S. PATENT DOCUMENTS

| | | | |
|---|---|---|---|
| 3,890,065 | 6/1975 | Eller et al. | 417/407 |
| 3,938,334 | 2/1976 | Matthews | 417/329 |
| 3,981,626 | 9/1976 | Onal | 417/89 |
| 4,003,678 | 1/1977 | David | 417/88 |
| 4,086,030 | 4/1978 | David | 417/406 X |

*Primary Examiner*—Leonard D. Christian

*Attorney, Agent, or Firm*—Christie, Parker & Hale

[57] ABSTRACT

While in a well, a downhole turbo-machine of a series of turbine stages and pump stages is driven by power fluid circulated into the turbine stages from the surface. A branch stream from the power fluid passes through a centrifugal cleaner and is cleansed of solid material. The turbine stages drive the centrifugal cleaner. The cleansed stream becomes lubricant for the turbo-machine bearings. On the turbine side, the lubricant stream passes at substantially cleaner discharge pressure into longitudinal passages between turbine shrouds and an alignment tube to journal bearings and journals located between turbine stage stators and a drive shaft driven by the turbines. Annular channels between separate shrouds effect communication between the longitudinal passages between the shrouds and the alignment tube. On the pump side, the lubricant stream is first directed so that it can act on a thrust bearing runner and apply a force in opposition to an otherwise unbalanced axial force. A low pressure discharge from the thrust bearing runner supplies galleries that feed journal and journal bearings of the pump stage stators. Gallery pressure is maintained positive with respect to the pump stage bearings by a feed to the gallery in excess of bleed-out of the bearings. A check valve relieves any excess gallery pressure to that of the next to the last turbine stage fluid passage. Lubricant bleeds from the journals and journal bearings into the fluid stream passing through the turbine pumps.

39 Claims, 11 Drawing Figures

(TO FIG. 2D)
46
150
199
216
200
160
154
214
224
147
162
61
62
158
156
314
316
318
332
364
334
64
200
63
24
322
320
324
326
328
330

DOWNHOLE CLEANER ASSEMBLY FOR CLEANSING LUBRICANT OF DOWNHOLE TURBO-MACHINES WITHIN WELLS

BACKGROUND OF THE INVENTION

The present invention relates in general to downhole well machinery powered by power fluid from the surface and which lubricates bearings of the machinery from a branch stream of the fluid that has been cleansed by a cleaner of the machine. In particular, the present invention relates to turbo-machines with centrifugal cleaners for separating solids from fluids downhole in wells and to a centrifugal cleaner that provides a solid-free lubricant stream from power fluid, which lubricant stream loads a thrust bearing runner and lubricates journal bearings and journals of pump and turbine stages, with the turbine stages being powered by the balance of the power fluid.

Downhole turbine machinery for use in petroleum and water wells is known. Turbine stages of the machinery powered by power fluid from the surface of the wells drive staged axial flow pumps that in turn force well fluid to the surface. The turbo-machinery operates at incredible speeds and is subject to considerable pressure differentials. Speeds on the order of 65,000 RPM can be experienced. Power fluid pressure differentials of as much as 280 $Kg/cm^2$ exist.

These very high speeds result in very severe bearing conditions. Under these conditions small particles in lubricant erode bearings rapidly. High pressure differentials translate into the same problem by producing high lubricant stream velocities across bearing surfaces, and entrained tiny particles in the lubricant have enormous erosive power.

To avoid excessive turbine blade wear, power fluid is maintained comparatively free of solid, abrasive materials. Usually, the power fluid receives treatment at the surface to remove solid materials. Power fluid, therefore, appears attractive as a lubricant.

The turbine blades can stand a modest solid content in the power fluid. The turbo-machine's bearings, however, cannot tolerate solids concentrations acceptable by the turbine blades. Removal of solids at the surface to an acceptable concentration for lubrication purposes is wasteful. The capacity of the solid removal equipment with adequate solid removal for lubrication must be large enough to handle the flow rate for the entire power fluid stream, including that which powers the turbines, unless a separate line is run for lubricant. The running of a separate line for lubricant from the surface to the bottom hole location is obviously not desirable for it complicates well plumbing.

Spent power fluid exhausted from downhole turbo-machines may be circulated in a closed power fluid system whereby the fluid returns to the surface in a separate tubing string from other strings passing fluids into and from the well. Alternatively, in an open system spent power fluid can be discharged into well fluid to form a production fluid stream. Typically, in this instance, the production fluid stream of both spent power fluid and well fluid passes up an annulus between the well casing and the power fluid supply string. Production fluid can, however, travel up a tubing string of its own. In the open system, power fluid picks up solids from the well fluid. In both open and closed systems, power fluid streams also pick up solid particles in the course of travel through the various tubing strings.

Accordingly, it is desirable to provide in effect two power fluid streams, one having an extremely low solids content for lubricant purposes, and one having a higher permissible solids content for driving the turbines and to originate the clean stream downhole.

SUMMARY OF THE INVENTION

The present invention provides for use in underground wells a downhole machine powered by a power fluid stream fed to the machine from the surface and which takes a portion of that stream in the downhole location and cleans it of entrained solid matter. The cleansed stream, free of solid matter, lubricates the bearings of the machine. Accordingly, the power fluid as a whole can be used for powering the machine with a level of solid content higher than that acceptable to lubricate the machine's bearings, while providing a lubricant stream of sufficiently low solid content for lubrication purposes at the downhole location.

In one form, the present invention contemplates a downhole pump powered by a downhole engine that in turn receives its energy from power fluid circulated from the surface of a well. The downhole machine has bearings requiring lubrication. A centrifugal cleaner powered by the engine subjects a portion of the power stream to a centrifugal force field that separates the solids out of the stream to form a cleansed lubricant stream. The lubricant stream then lubricates the machine's bearings.

In a particular form, the present invention contemplates a downhole turbo-machine of stages of turbines that drive stages of pumps. A power fluid stream drives the turbines. A centrifugal cleaner driven by the turbines separates solids out of a slip stream taken from the main power fluid stream to form a lubricant stream. This lubricant stream under a positive pressure head with respect to the pressure in the pump stages lubricates journal bearings and journals of the stators in the pump stages and discharges into the well fluid passing through the pump stages. The lubricant stream also lubricates journal bearings and journals of the stators in the turbine stages. Preferably, the positive pressure head of the lubricant is maintained by a slip stream flow rate greater than the flow rate through the journal bearings. The positive head is prevented from becoming excessive and affecting the function of an axial thrust balancing assembly by communication with a turbine stage that passes fluid at a pressure greater than the well fluid being pumped in the pump stages. A positive pressure differential to feed lubricant to the turbine stages is assured by using lubricant directly from the cleaner, which is at the highest pressure possible in the system. Any incidental lubrication required by the highest pressure stage turbines may be done with uncleaned power fluid.

An even more specific form of the present invention contemplates an axial turbo-machine for downhole well use which has tandemly staged turbines that drive through common drive shaft tandemly staged pumps. An axial thrust balancing system includes a thrust bearing runner that offsets axial thrust in one direction or another by fluid pressure acting on faces of the runner in opposition to the net axial force. Preferably the runner mounts to the drive shaft between the pump and turbine stages. The fluid pressure is provided by a cleansed lubricant stream emanating from a centrifugal cleaner driven in rotation by the turbines. Passageways to either face of the thrust bearing runner provide a net axial force opposing unbalanced axial forces on the turbo-machine. This net axial fluid imposed force is by pressure of the fluid on the runner when the runner face feeling the pressure is hard up against or very close to stops. This position of the runner close to the stops results from the unbalanced axial force which acts in opposition to the corrective fluid produced force. The opposition pressure of the lubricant stream forces a slight displacement of the runner that allows the lubricant stream to bleed into a pressure regulated low-pressure gallery. Pressure reducing orifices upstream of the faces drop the pressure rapidly when the runner moves away from a stop an amount sufficient to establish a leak path flow area greater than the orifice area. The same type of leak path exists on each side of the thrust bearing runner to open when the pressure acting on that side exceeds opposition thrust. Regardless of the position of the thrust bearing runner, there is always lubricant flow into the gallery past the runner. The cleansed stream in the pressure regulated gallery feeds lubricant to journals and journal bearings of the pump stage stators. Pressure regulation preferably is effected by pressure communication with an intermediate turbine stage passage, for example, the next to the last turbine stage and a flow rate into the low-pressure gallery higher than the flow rate of lubricant discharged through the journal bearings. Pressure regulation is necessary to assure a pressure drop across the thrust bearing runner. The pressure being higher than the well fluid being pumped by the pump stages assures positive flow of lubricant through the interfaces between the journal and journal bearings of the pump stage stators. Consequently, no solid contaminants from the well fluid enter the bearing areas. For the journal and journal bearings of the turbine stages, a branch stream from the discharge of the centrifugal cleaner at comparatively high pressures provides the lubricant.

Structural incidents of the present invention include the use of a plurality of stator and rotor shrouds in both the pump and the turbine sections of the turbo machine. Longitudinal passages in the turbine section formed by longitudinal slots in the external surface of the shrouds communicate with one another through annular channels formed of steps on the external end corners of the shrouds. The shrouds fit within an alignment tube to complete the definition of the lubricant passages. Radial drillings through the shrouds, blades and hubs of the stators form lubricant paths into the journal and journal bearings in both the turbine and pump stages. In the case of the pump stages, these radial drilings open into annular channels between the pump stage shrouds and the pump stage alignment tube, and radial drillings from a gallery outside the alignment tube into the channels provide the communication for lubricant.

The entire turbo-machine has a housing preferably formed of a pair of connecting tubes joined by a central coupling with the alignment tubes of the pump and turbine stages received in the connecting tubes.

These and other features, aspects and advantages of the present invention will become more apparent from the following description, appended claims and drawings.

DESCRIPTION OF THE PREFERRED EMBODIMENT

Figure 1:
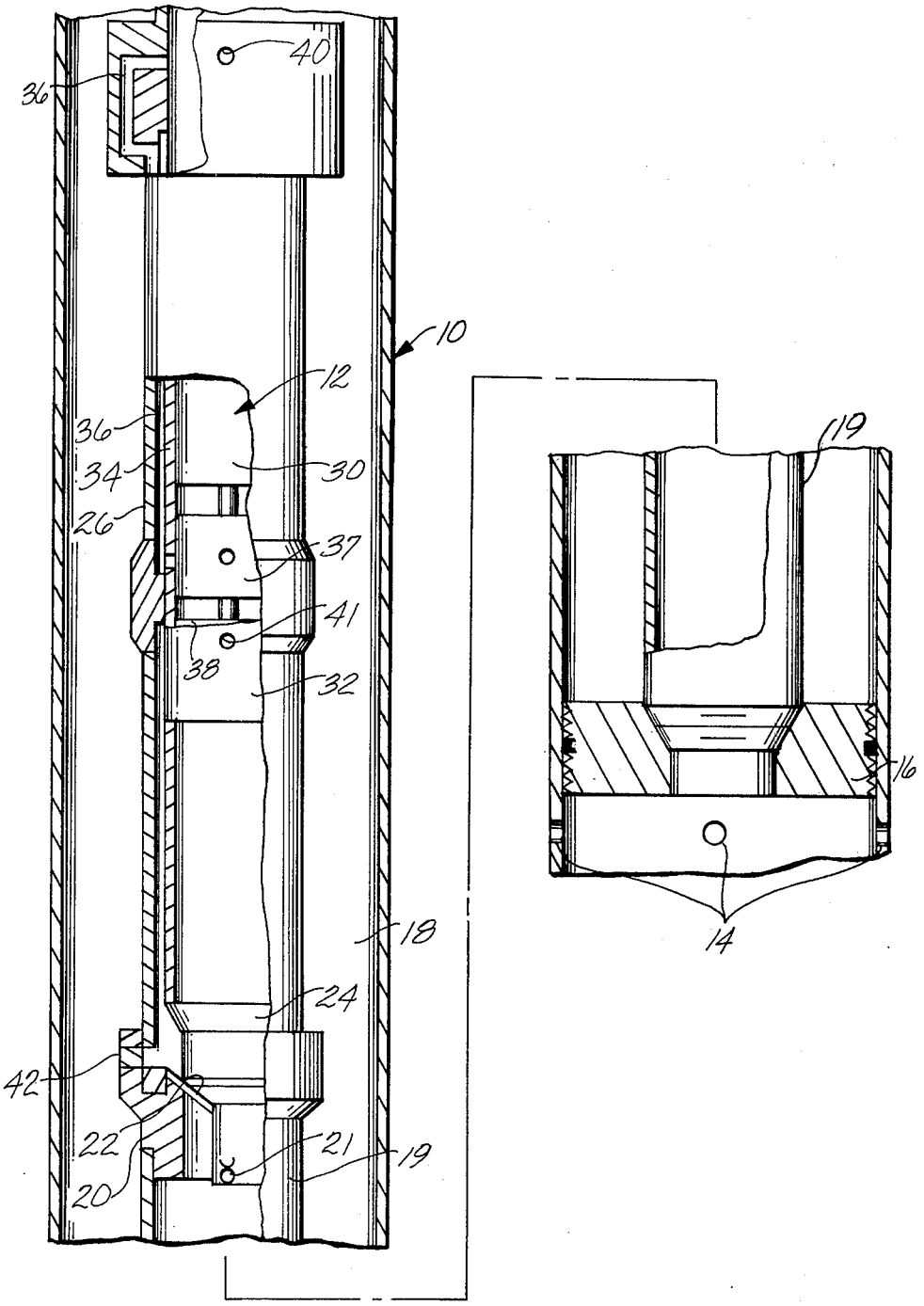
FIG. 1 illustrates schematically, in vertical elevation and partial half-section, a turbo-machine of the present invention in the form of a downhole, axial flow turbine and pump at a downhole location in a well, say for petroleum or water.

FIG. 1 shows the general organization of the bottom hole assembly that receives a turbine and pump of the invention together with ancillary apparatus and environments. A casing 10 at the downhole location lines the wall of a well. A pump and turbine assembly 12 within the casing pumps well fluid from a formation through perforations 14 in the casing to the surface of the well. A packer 16 seals the bottom of the casing to separate formation fluid from a casing annulus 18. A lower section of tubing 19 attaches to packer 16 and supports a standing valve shoe 20. A standing valve 21 in the standing valve shoe acts as a check valve and permits upward well fluid flow through tubing 19. A standing valve seat 22 in the shoe provides a seat for a nose 24 of pump and turbine assembly 12.

Pump and turbine assembly 12 is contained within a lower end section 26 of a tubing string that extends to the surface. Power fluid flowing down inside the tubing string drives the turbines and provides the power to pump well fluid up the well. The pump and turbine assembly includes a housing that contains and unifies the elements of the assembly. As will become apparent as this description proceeds, the housing comprises a coupling that joins connector tubes at either end of the coupling and the connector tubes.

A bottom hole assembly is formed of lower section 26 of the tubing string, standing valve shoe 20 and valve 21, tubing 19, and packer 16.

The pump and turbine assembly generally consists of a turbine section 30 at the top and a pump section 32 at the bottom coupled together as through a connecting tube assembly 34. The turbine section includes a plurality of turbine stages. The pump section includes a plurality of pump stages. Power fluid from the tubing string passes through a side passage and annulus 36 and through connecting tube assembly 34 between the pump and turbine sections. Here the power fluid enters the first stage of a multistage turbine drive. A portion of the fluid does not enter the turbine drive but instead forms a slip or branch stream that is cleansed by a downhole cleaner 37 and used to lubricate various bearings of the assembly and in the operation of a thrust bearing runner 38.

Exhausted power fluid may exhaust into annulus 18 within the casing through radial ports 40 in the connecting tube assembly and tubing section 26. The turbines within turbine assembly 30 drive axial flow pumps in pump section 32. These pumps in turn increase the head of well fluid and discharge the well fluid from the pump section into annulus 18. Such well fluid flows through ports 41 in connecting tube assembly 34 and a passage 42 between the pump section and tubing section 26 out into annulus 18. The well fluid and the exhausted power fluid form the bulk of the production fluid of the well. Lubricant derived from the power fluid also exhausts into the annulus with the well fluid and contributes to the production fluid. As is known, different schemes permit the maintenance of power fluid independent of production fluid. For example, a tubing string from port 40 can rise to the surface in a closed power fluid circuit.

Pump and turbine assembly 12 is of the free type and can be circulated out of the well by fluid pressure by reversing the flow of fluid and forcing fluid down annulus 18 and into passage 42 under nose 24 of the pump section.

Bearings of the bottom hole turbo machinery of the type just generally described are subject to rather harsh environments. The rotary speeds of the turbines and the pump are considerable, in the neighborhood of 70,000 RPM. Pressure differentials can also be large between lubricant source and discharge, an illustrative differential being 280 $Kg/cm^2$ (about 4,000 p.s.i.). These high speeds and pressure differentials add to lubrication problems by increasing the damaging consequence of solids in a lubricant. Bottom hole machinery failure caused by lubrication failure means downtime for a well and the expense of retrieving the bottom hole turbine and pump assembly. Power fluid that drives the turbines is comparatively free of solid particles and is cleansed of solid particles at the surface through various techniques. The solids remaining in the power fluid are at an unacceptably high level for use of the power fluid as a lubricant. But to cleanse all the power fluid to an extent required for satisfactory bearing life is not satisfactory. Power fluid with too much solids for lubrication is quite satisfactory for the turbine blades. It is uneconomical to have as a power fluid for the turbines a fluid with a solids content satisfactory for bearing lubrication.

The present invention provides an answer to this problem by cleaning a branch stream of the power fluid for lubrication purposes in the turbo-machinery while down hole. This avoids the problem of running a separate line for lubrication purposes alone from the surface to the bottom hole location, or of providing a power fluid with a solids content satisfactory for lubrication and using that fluid to drive the turbines.

Figure 2A:
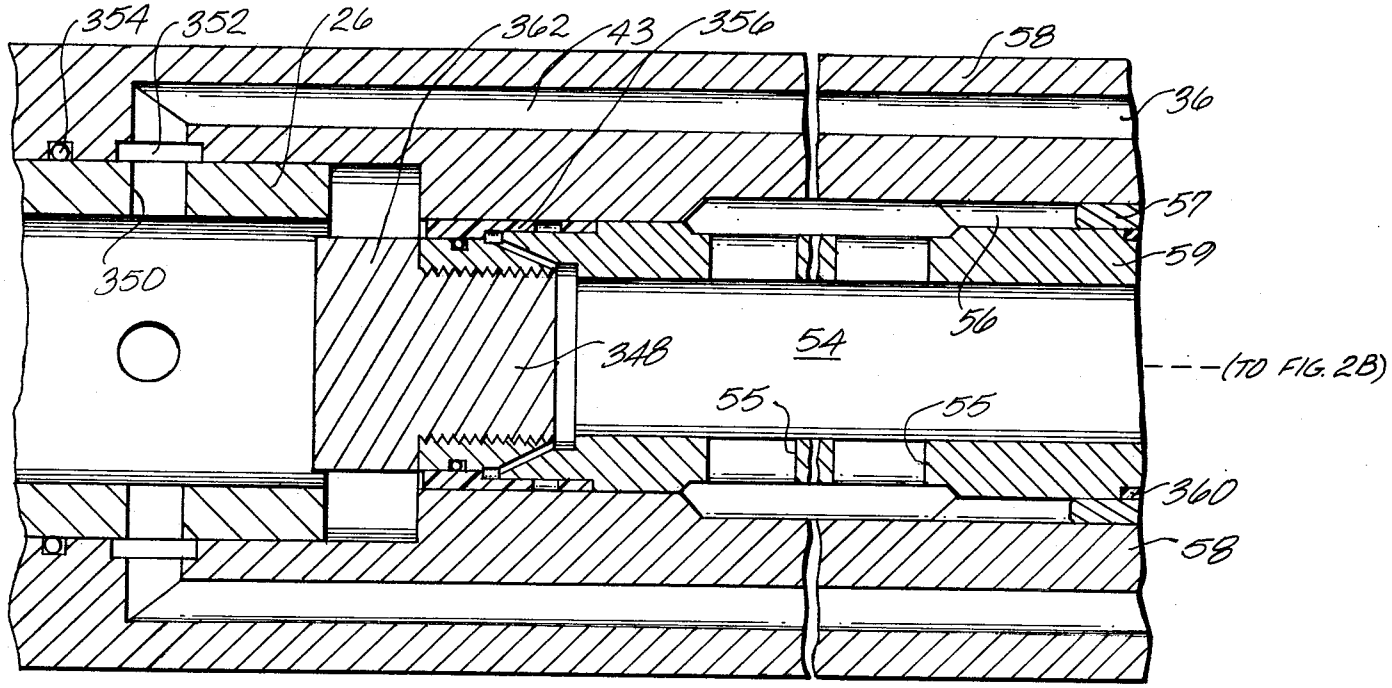
FIGS. 2A, 2B, 2C, 2D, 2E and 2F are detailed, predominantly half-sectional views of the turbine stages, cleaner, pump stages, and attendant lubricant flow paths for the presently preferred turbo-machine of the present invention. The various views connect up into a turbo-machine having a continuous and straight axis. There is some overlap in the views for clarity and some parts omitted as unnecessary.
Figure 2B:
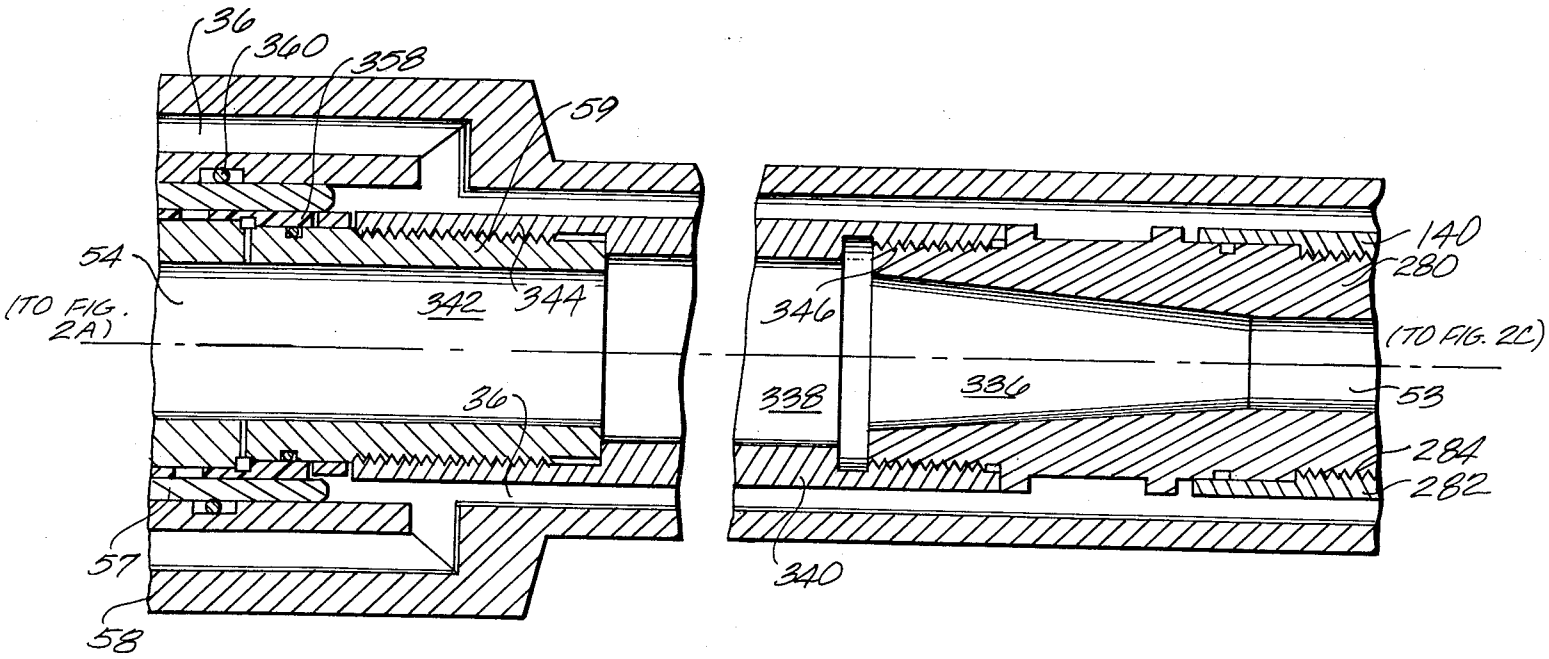
Figure 2C:
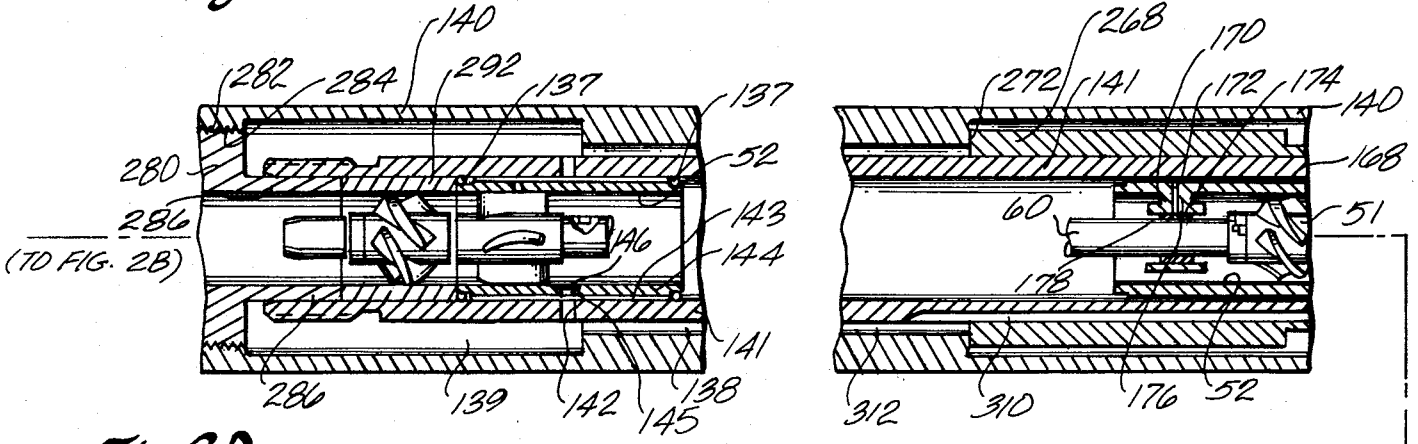
Figure 2D:
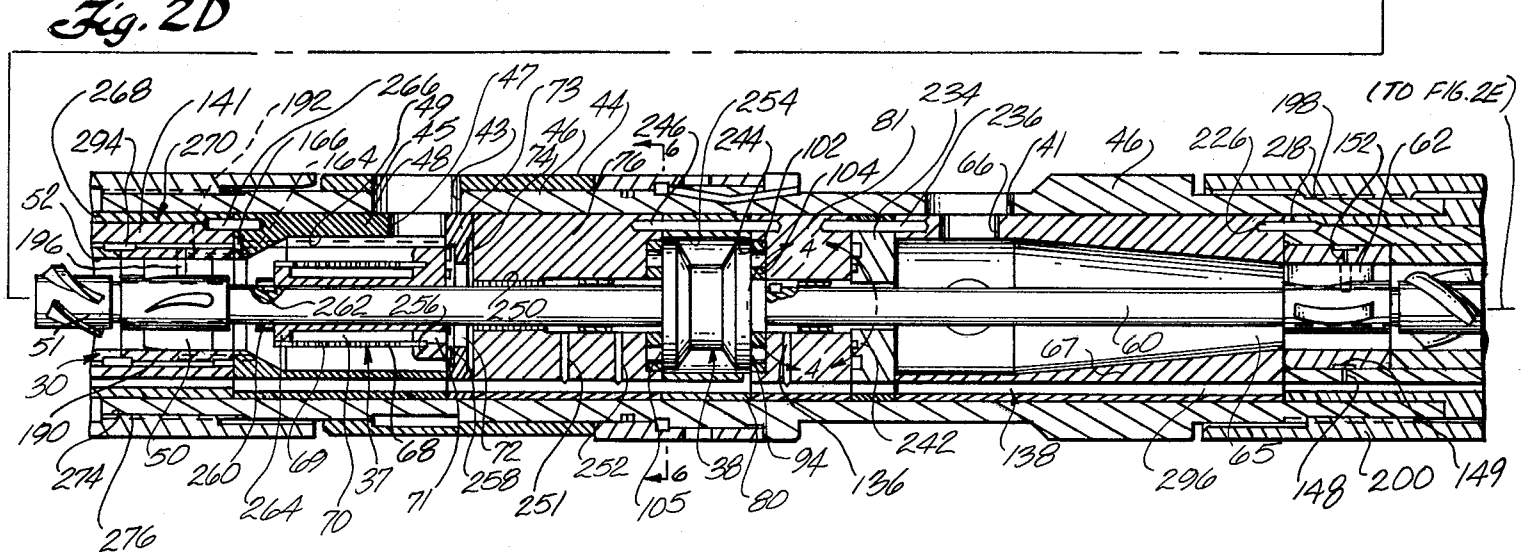

With reference to FIG. 2, and especially FIG. 2D, pump and turbine assembly 12 with the lubricant cleaning means of the present invention is illustrated. From the previous discussion, power fluid from a source at the surface of a well passes through a tubing string and passages, such as passages 36, into the assembly. The assembly receives power fluid through a radial port 43 in a seal spacer 44, a corresponding and aligned radial port 45 in a coupling 46, and a corresponding and aligned radial port 47 in a cleaner housing 48. This family of ports opens into a cleaner chamber 49. Chamber 49 contains cleaner 37. The bulk of the power fluid bypasses the cleaner and enters turbine stages 30. The turbine stages are constituted of stationary stator and rotatable rotor pairs, such as shown at 50 and 51, respectively. The number of turbine stages varies depending upon the requirements of a well. Power fluid flows axially up a passage 52 in which the turbine rotors and stators reside and exits into a diffuser passage 53 (FIG. 2B) and into a discharge passage 54. Exhausted power fluid exhausts from passage 54 out ports 55 (FIG. 2A) into an annulus 56, and from there into the casing surrounding the assembly through radial ports 40 (see FIG. 1). There the power fluid mixes with well fluid and spent lubricant to form a production fluid stream that goes to the top of the well for collection and further processing. As seen in FIGS. 2A and 2B, an annular gland 57 pressed between a collar 58 of tubing section 26, and a tube 59 separates annulus 56 from passages 36. Passages 36 in this specific description are formed in part by longitudinal side passages in tubing string 26.

Thus, what has been described so far provides for power fluid to enter cleaner chamber 49 from tubing string 26 by way of passages 36. The fluid then enters passage 52 to drive the turbines. Spent power fluid enters passage 54 and leaves the assembly through ports 55 and 40 into annulus 18 within casing 10 of the well.

As can be seen in FIGS. 2C and 2D, the turbines of the turbine stages are keyed to a drive shaft 60 that extends coaxially with the turbine and pump assembly throughout the turbine section cleaner 37 and pump section. The drive shaft is keyed to cleaner 37 to drive the cleaner and thus the cleaner derives its power from the turbines.

Figures 2E, 2F:
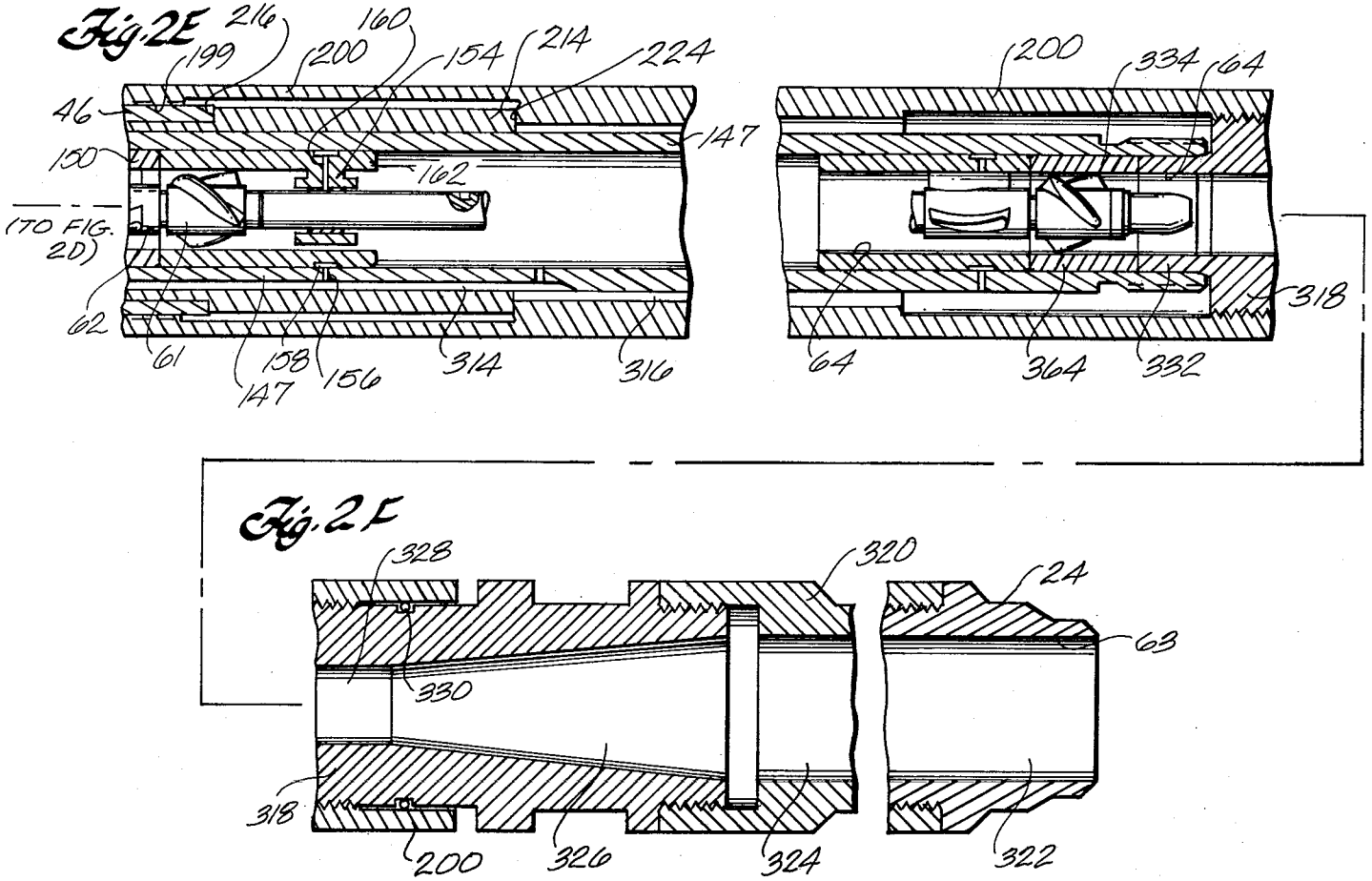

With general reference to the pump stages shown in FIGS. 2D and 2E, drive shaft 60 extends completely through the stages which are constituted of a plurality of rotors and stators, such as shown individually at 61 and 62, respectively, at the extreme upper end of the pump assembly. Each rotor is keyed to drive shaft 60 for the driving of the rotor by the shaft. As seen in FIG. 2F, well fluid enters the pump stages at an entrance 63 in nose 24 and passes axially through a pump passage 64 (FIG. 2E) of the pump stages into a diffuser passage 65 (FIG. 2D). As seen in FIG. 2D, well fluid discharges through radial ports 66 in a diffuser body 67 and into ports 41 that are aligned with ports 66. Ports 41 discharge into pump casing annulus 42, thence to casing annulus 18.

Thus drive shaft 60, driven by the turbines of the turbine stages, drives the rotors of the pump stages to increase the head of well fluid. This fluid discharges into diffuser passage 65 to reduce its velocity head and increase its static head. Thereafter the fluid passes outside of the assembly into an annulus between the assembly and the casing through passages that include ports 41 and annulus 42. This fluid forms a part of the production fluid that rises to the surface of the well.

With reference to FIG. 2D, power fluid entering chamber 49 does not all go to the turbine stages. Some of this fluid branches off and passes into cleaner 37 for the removal of small, entrained solids in the power fluid that could be detrimental to the lubrication of various components of the assembly. Cleaner 37 is keyed to drive shaft 60 and rotates with that shaft. A centrifugal force field of considerable magnitude results. This force field is felt in the individual passages within the cleaner wall, such as passages 68 in a wall 69 of the cleaner. A pressure differential, however, exists between the fluid radially outward from wall 69 and in chamber 49, and the fluid radially inside wall 69 in an annular chamber 70. The centrifugal force field is insufficient to prevent the passage of fluid through passages 68 into chamber 70, but it is sufficient to prevent the passage of heavier, solid materials into chamber 70.

Cleansed fluid leaves chamber 70 through a longitudinal passage 71 and enters an annular chamber 72 for distribution to various lubrication galleries of the assembly.

Figure 3:
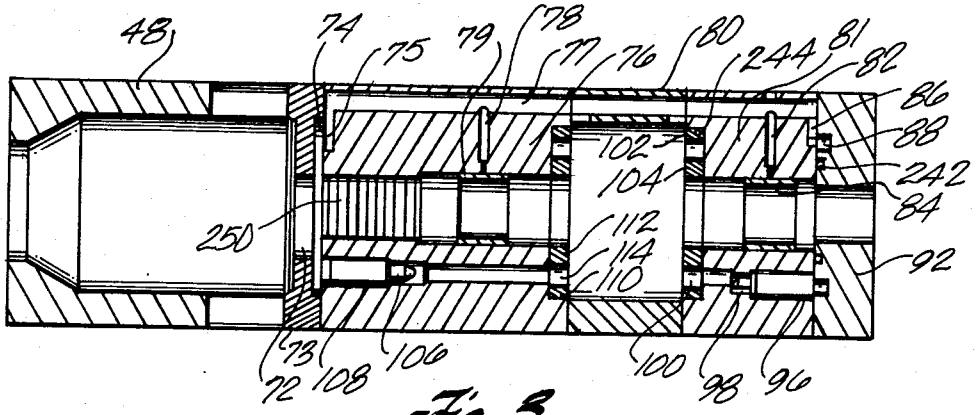
FIG. 3 is a half-sectional detailed view of a centrifugal cleaner chamber, labyrinth seal, thrust bearing runner chamber, and attendant structure of the turbo-machine of FIG. 2.

With reference to FIG. 3, it can be seen that chamber 72 is formed of a centered hole in a disc-shaped end cap 73 and a relief 74 opening into the hole from one end face of the cap. A radial, end-milled slot 75 in a thrust plug 76 communicates relief 72 with a longitudinal lubricant passage or gallery 77 in the plug. Passage 77 continues parallel to the axis of the assembly as a main high-pressure lubricant supply artery for the pump end of thrust bearing runner 38 and journal bearing and journal lubrication. Branches from this artery supply lubricant to various bearing areas of the assembly. Thus, a radial branch passage 78 from passage 77 supplies lubricant fluid to the interior bearing surface of a journal bushing 79 that is in bearing relationship with drive shaft 60. Gallery 77 continues through a thrust bearing runner housing 80 and into a second thrust plug 81. A radial branch passage 82 from gallery 77 lubricates the interior bearing surface of a journal bushing 84 disposed within an axial bore of thrust plug 81. A radial end-milled slot or passage 86 from gallery 77 supplies lubricant to an annular passage 88 in an end cap 92. With reference to both FIGS. 3 and 2D, this passage supplies lubricant to act on a pump side end face 94 of thrust bearing runner 38 through a passage 96 and a pressure reducing orifice 98, both in thrust plug 81, and an annulus 100 defined by a pair of concentric, wear resistant bearing rings 102 and 104.

A similar lubricant supply exists on a turbine end face 105 of thrust bearing runner 38. Thus a pressure reducing orifice 106 is in a passage 108 of thrust plug 76 and opens into relief 74. A pair of concentric, wear-resistant bearing rings 110 and 112 define an annulus 114 for lubricant. Lubricant from relief 74 acts on end face 105 through orifice 106 and passage 108 and in the opposite direction from the lubricant pressure acting on end face 94. As is known, thrust bearing runner 38 acts to take up thrust in the assembly by acting as a valve to admit or prevent fluid from acting on its opposed faces 94 and 105. As will be explained immediately below, when axial thrust on the assembly forces the thrust bearing runner hard against one of the set of bearing rings, fluid pressure on the opposite set decreases owing to a leak path created at that end. Pressure builds up on the end in engagement and opposes the thrust. Ideally the thrust bearing runner will float between the stops defined by the sets of bearing rings.

Figure 4:
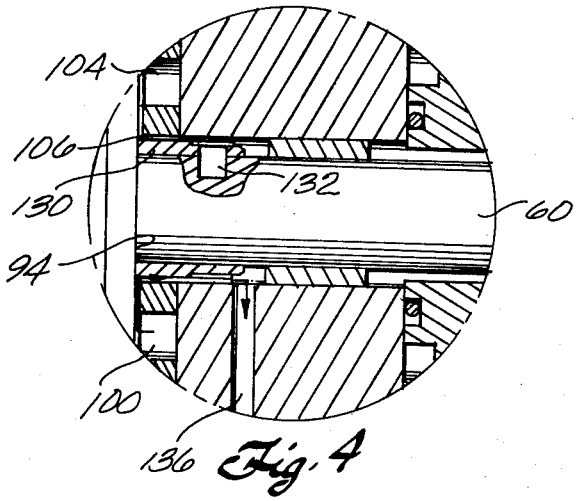
FIG. 4 is a half-sectional detail taken in the area 4—4 of FIG. 2D detailing the flow paths of the lubricant to and by one face of the thrust bearing runner of the turbo-machine of the present invention.

With reference to FIG. 4, a detail of the pump end of the thrust bearing runner and adjacent structure illustrates the flow path of lubricant when the runner is hard against the turbine end bearing rings. Lubricant enters annulus 100 from orifice 98. It leaks past face 94 and into an annulus 116 between inner ring 104 and a hub 130. Hub 130 is staked to shaft 60 by a pin 132. Hub 130 forms a part of thrust bearing runner 38. From annulus 116 the fluid passes out a radial passage 136. As can be seen in FIG. 2D, passage 136 empties into longitudinal gallery 138. A pair of ports 137 communicate the runner chamber in which runner 38 resides to gallery 138. As will be developed, this flow path from the chamber augments the flow path that includes radial passage 136 to assure proper response of the runner. The flow path through ports 137 also assures cooling of runner faces. Orifice 98 assures that pressure will drop once the area for leakage past face 94 substantially exceeds the area of orifice 98. A similar pressure reduction event holds for the opposite runner bearing face because of orifice 106. Before pressure drops, the pressure on a runner bearing face will be about cleaner discharge pressure. Obviously, to get the thrust bearing runner hard up against a stop and to seal off lubricant flow past the stop, the unbalanced axial force must exceed a predetermined minimum. If the thrust does not exceed the minimum, a gradually increasing in balance of fluid pressure acting on the thrust bearing runner opposing the unbalanced thrust keeps the runner from hitting the stop.

Gallery 138 extends substantially the length of the turbine and pump sections and supplies the lubricating fluid to the journal and journal bearings of the drive shaft and stators, respectively, for the pump stages.

As will be developed with reference to FIG. 2C, gallery 138 also communicates with the next to the last or penultimate turbine stage to establish the bleed pressure for the thrust bearing runner and to establish a limit on the positive pressure for lubricating the journal and journal bearings of the pump section. Gallery 138 terminates in an enlarged annular chamber 139 formed between a connector tube 140 and an alignment tube 141. A radial passage 142 from chamber 139 and through alignment tube 141 empties into an annulus 143 between alignment tube 141 and a shroud 144. O-rings 137 at either axial end of annulus 143 seal the annulus to maintain the integrity of gallery pressure that exists within the annulus. A passage 145 through shroud 144 communicates with turbine discharge from the next to the last stage turbine in passage 52. A check valve 146 in passage 145 permits the relief of gallery pressure in gallery 138 to establish the pressure in the next to the last turbine stage as the maximum pressure in gallery 138. At gallery pressures lower than the pressure in this turbine stage, the check valve closes and pressure builds up in the gallery to an equilibrium pressure approaching turbine discharge pressure. The supply of lubricant to gallery 138 invariably exceeds lubricant flow from the gallery into the bearings. Thus gallery pressure is always maintained above lubricant discharge pressure from the bearings. Gallery pressure must be low enough, however, for the required pressure drop across the thrust bearing runner.

Thus gallery 138 forms the supply artery for lubricant used in the pumping stage and has its pressure controlled so that it does not exceed the pressure in the next to the last stage turbine.

In some detail gallery 138 supplies lubricant to the bearing of the pump stage as follows. As will be recalled, the last pump stage is formed of stator 62 and rotor 61. A radial passage 148 through an aligning tube 147 opens into an annular channel 149 of a stator shroud 150 for stator 62. A radial passage 152 through the shroud and one of the blades of stator 62 lubricate the bearing between the stator and drive shaft 60. This lubrication is seen again for a penultimate pump stage stator 154. A radial lubricant passage 156 opens from passage 138 into an annular channel 158 and from this channel through a radial passage 160 in a shroud 162 to the journal and journal bearing between the stator and drive shaft 60. Identical passages are found for the other stator stages of the pump.

The turbine section in general is lubricated with high pressure clean lubricant from cleaner 37. A gallery shown in phantom at 164 in FIG. 2D communicates with relief 74 through a radial passage similar to passage 75 (see FIG. 3). (Passage 164 is at the same radius as passage 77, seen in FIG. 3, but because the passage is not in the plane of the section, it appears foreshortened.) Gallery 164 extends through cleaner housing 48 to end at a radial end-milled annular channel 166. Channel 166 opens into longitudinal passages 168 (FIG. 2C) between the turbine stage shrouds and alignment tube 141. These passages supply the lubricant for lubricating the journals and journal bearings of the stators of the turbine stages. With reference to FIG. 2C, the lubrication of second stage stator 170 is typical. A radial passage 172 extends through a turbine shroud 174 from passage 168. Passage 172 extends through a blade 176 of the stator to a journal bearing 178 of the stator and a cooperating journal of drive shaft 60. Because the power fluid pressure is higher than the pressure of lubricant at the discharge of cleaner 37, say in annular chamber 72, it is necessary to lubricate the first turbine stage stator journal bearings and journal with power fluid that has not gone through the cleaner. With reference again to FIG. 2D, the power fluid passes through a stator shroud 190 in a longitudinal passage 192 from chamber 49. From passage 192, fluid passes into a radial passage 196 in the shroud and stator blade and from the passage into the journal and journal bearings between stator 50 and drive shaft 60.

Lubricant fluid that has performed the lubrication function of the journal and journal bearings in both the pump and turbine stages passes into the pump and turbine streams as leakage fluid from the bearings.

Thus power fluid from a surface facility that is used to drive the turbines of a downhole turbo-machine has a portion of the fluid diverted to provide lubricant. The diverted power fluid is cleansed in a rotary cleaner and provides the lubricant used to lubricate the journal and journal bearings between the stators and the drive shaft. To be sure that the lubricant pressure does exceed a limit that would adversely affect the function of the thrust bearing runner, the bleed pressure from the thrust bearing runner is controlled by the discharge pressure of the next to the last turbine stage. The bleed pressure, which is the main gallery pressure, is positive with respect to lubricant discharge pressure from the pump stages because the flow rate into the gallery exceeds the discharge flow rate from the pump stage bearings. When bleed pressure does not equal the next to the last turbine stage pressure, pressure builds up in the gallery 138 until it does. In addition, by maintaining the lubricant pressure higher than any pressure seen in the pump stages, positive lubricant flow from the source of lubricant through the interfaces between the journal and journal bearings of the stators occurs.

In greater detail, the construction of the power fluid lubricated, turbine-powered axial flow pump of the present invention will now be described.

With reference to FIG. 2 and especially FIG. 2D, the pump and turbine stages are physically separated by coupling 46. On the pump side, that coupling is externally threaded at 198 and receives internal threads 199 of a connector tube 200. Connector tubes 200 and 140 and coupling 46 form the housing of the assembly. With reference to FIG. 2E, an alignment tube 214 has a step-down shoulder 216 that butts up tightly against coupling 46. As seen in FIG. 2D, a reduced diameter section 218 of the alignment tube extends longitudinally of the pump axially within the coupling to butt up against the pump facing end of diffuser body 67. Back to FIG. 2E, alignment tube 214 in turn receives by a shrink fit internal alignment tube 147. An interior shoulder 224 of connector tube 200 butts up against the pump facing end of alignment tube 214 opposite diffuser body 67. Alignment tube 214 maintains concentricity of alignment tube 147 at the discharge end of the pump section. Back to FIG. 2D, index pins 226 between diffuser body 67, alignment tube 214 and alignment tube 147 orient these pieces angularly about the longitudinal axis of the entire assembly so that various galleries, ports, and passages register. For example, the pins assure that ports 66 of diffuser body 67 line up with ports 41 in coupling 46.

With continued reference to FIG. 2D, diffuser passage 65 receives fluid from the last pump stage and converts some of the velocity head of that fluid into pressure head prior to the fluid's passage into the casing through ports 66 and 41. An end cap 234 butts up against the end of the diffuser body opposite the last pump stage, the turbine facing end of the diffuser body. Indexing pins 236 pass through end cap 234 and index into diffuser body 67. Thrust plug 81 on the turbine side of end cap 234 and within coupling 46 butts up against end cap 234 and also indexes with respect to the cap by pins 236.

As previously described, thrust plug 81 provides a journal bearing for drive shaft 60 with a bushing shown in FIG. 3 at 84. An O-ring 242 in end cap 234 seals against plug 81. Wear rings 102 and 104 receive in a counterbore 244 in an end face of plug 81.

Housing 80 for thrust bearing runner 38 indexes with plug 81 through index pins 246. The housing also indexes with thrust plug 76 through the same pins. Again the indexing provides continuity for the various fluid passages through these various parts.

Plug 76 is received within coupling 46 and has a labyrinth seal 250 separating the cleaner and turbine stages from the pump stages. As seen to best effect in FIG. 5, radial passages 251 in plug 76 provide a bleed from this labyrinth seal into gallery 138. Radial passages 252 in plug 76 provide thrust bearing runner bleed from the turbine side of the thrust bearing runner. A foreshortened gallery 253 receives the discharge from some of the radial passages. This gallery complements gallery 138, but does not directly see penultimate turbine discharge pressure.

As will be recalled with reference to FIGS. 2D and 4, pressure within cleaner chamber 49 acts on the annular areas defined between the wear rings, rings 102 and 104, and 110 and 112, on opposite ends of thrust bearing runner 38. When thrust is excessive in one direction, say from the pump direction, the thrust bearing will be urged towards the turbine. Runner 38 will then move slightly away from wear rings 102 and 104 establishing the pressure of gallery 138 against face 94 of the runner, and for that matter, within a runner chamber 254, defined within housing 80. Pressure acting on runner face 105, however, will be greater than the gallery pressure because the gallery pressure is established by the next to the last stage of the turbine while the pressure on face 105 is essentially power fluid pressure. The thrust bearing will therefore move and tend to seek an equilibrium position between wear rings 110 and 112, and wear rings 102 and 104. Fluid leaves the runner chamber through two paths and enters gallery 138. The first is along shaft 60 and out radial passages 136 and 252. The second path is out ports 137. Good circulation exists around the thrust bearing runner to assure proper response to the forces acting on it and the faces of the runner and wear rings are kept cool.

With reference to FIGS. 2D and 3, an end cap 73 abuts against thrust plug 76 and forms part of one end of cleaner chamber 49. This end cap defines the radial limits of annular chamber 72 and relief 74. A base 256 of the cleaner has radial blades 258. These blades pump cleaned fluid from within annular chamber 70 to the outside of this chamber to maintain the integrity of the clean fluid in the chamber. The cleaner is staked to drive shaft 60 at a hub 260 of the cleaner by a pin 262 passing through the hub and into the drive shaft. A retaining collar over the pin may hold it home. A radial flange 264 at the turbine end of the cleaner defines that end boundary of annular chamber 70. Wall 69 attaches to flange 264 and is received in an annular slot of base 256. Wall 69 is cylindrical. Cleaner housing 48 indexes with adjacent parts through indexing pins, one of which is shown at 266 between turbine end alignment tube 141 and an outer turbine alignment tube 268. Coupling 46 receives turbine alignment tube 268 at a reduced diameter section 270 of the latter. Alignment tube 268 receives the end of turbine alignment tube 141 with a shrink fit.

As seen in FIG. 2C, connector tube 140 has an interior, radial shoulder 272 abutting up against the turbine facing end of alignment tube 268. This abutting relationship forces alignment tube 268 tightly up against cleaner housing 48. This abutting relationship in connection with the similar abutting relationship of pump end alignment tube 214 against diffuser body 67 forces the assembly pieces between them tightly against one another. As seen in FIG. 2D, connector tube 140 threads tightly onto coupling 46 through a threaded connection of connector tube internal threads 274 and external threads 276 of the coupling. As seen in FIGS. 2B and 2C, connector tube 140 at the turbine stage end of the assembly extends up to a threaded connection with a turbine diffuser body 280. This connection is defined by external threads 282 of diffuser body 280 in threaded receipt of internal threads 284 of connector tube 140.

As seen in FIG. 2C, turbine diffuser body 280 has a nose 286 received in aligning tube 141 that butts up tightly against a last stage turbine shroud 292.

With reference again to FIG. 2D and as previously described, high pressure lubricant feed, substantially at the discharge pressure from the cleaner, supplies the lubricant for the turbine end of the assembly and this feed emanates from chamber 72 through gallery 164 and longitudinal passages 168. Longitudinal slots in the turbine stage shrouds provide longitudinal passages 168 for the power fluid. Between shrouds, annular channels such as channel 294 effect inter-shroud continuity of passages 168 despite the angular orientation of individual shrouds about the longitudinal axis of assembly. As mentioned earlier, lubricant passes from passages 168 into the journal bearings and journals for the various turbine stage stators and the drive shaft.

Figure 5:
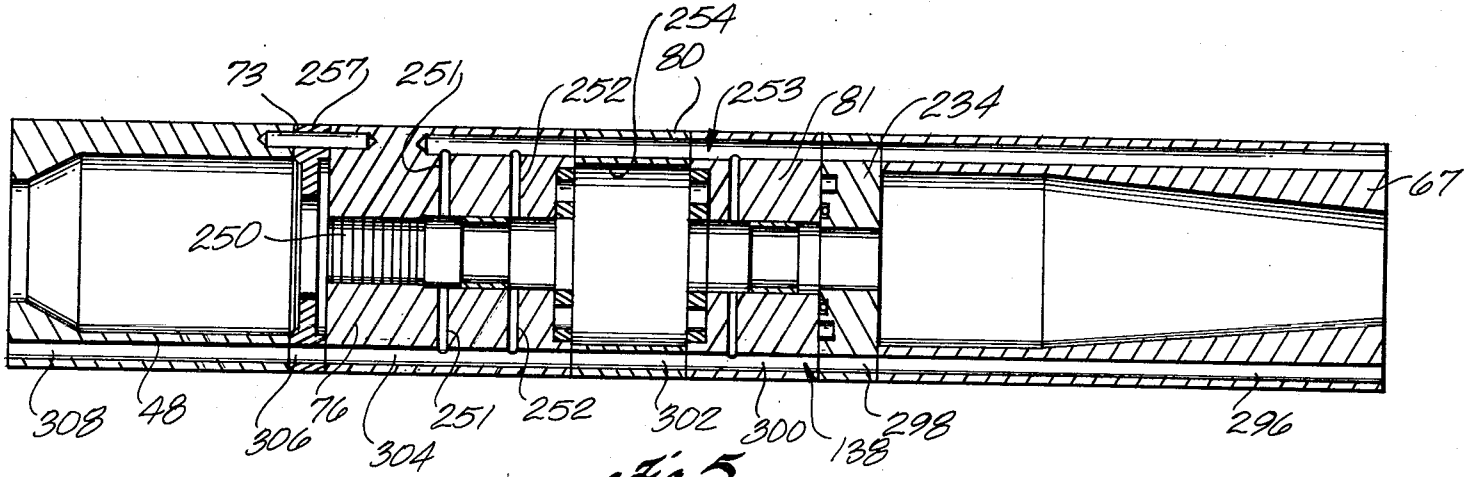
FIG. 5 is a view which illustrates, again in half-section, some of the flow passages and galleries of the lubrication system of the turbo-machine of FIG. 2.
Figure 6:
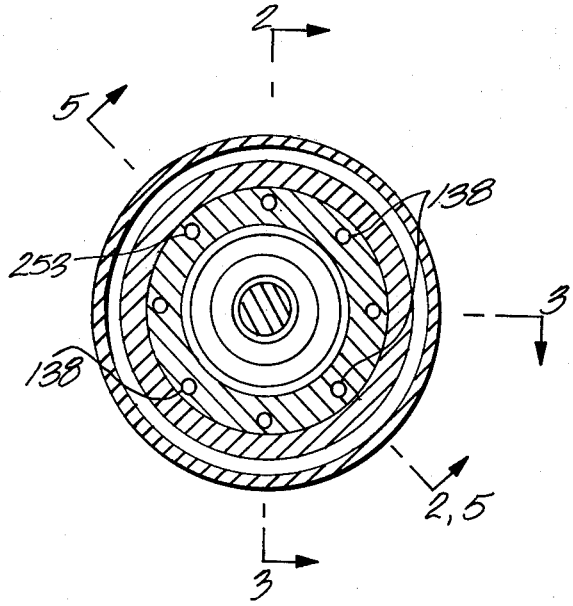
FIG. 6 is a sectional view taken at an axial location in the plane 6—6 of FIG. 2D showing section lines of FIGS. 2A through 2F, 3 and 5.

Galleries 138 that provide the bleed for the thrust bearing also provide the lubrication for the journal and journal bearings of the various pump stage stators and drive shaft. In the pump section there are four such passages, as can be seen in FIG. 6 by three galleries indicated at 138 and foreshortened gallery 253. The three passages 138 go to the next to the last turbine stage for pressure regulation. Passage 253, as shown in FIG. 5, only goes to the pump section. Each of the passages 138 is formed in the following manner. Beginning with FIGS. 2D and 5, and coupling 46 towards the pump end and progressing towards the turbine end, diffuser body 67 has a passage section 296 indexed with a passage section 298 of end cap 234 that in turn indexes with passage section 300 in thrust plug 81. This passage aligns with a passage section 302 in thrust bearing runner housing 80. A passage section 304 in thrust plug 76 registers with passage 302 of the housing and a passage section 306 of end cap 73. Cleaner housing 48 has a passage section 308 indexed with passage section 306. With reference again to FIG. 2C, longitudinal slots 310 (or flutes) on the outside of aligning tube 141 register with passage section 308 to form a continuation for passage 138. These slots go under alignment tube 268 to open into an annulus 312 that defines passage 138 from the slots to the end of the passage at turbine diffuser body 280.

The geometry of passage 138 in the pump section is similar. With reference to FIGS. 2D and 2E and just past diffuser body 67, longitudinal slots or flutes 314 in aligning tube 147 register with passage section 296 of pump diffuser 97. Alignment tube 214 forms the outer radial wall of the passage defined by the slots in this section. The slots open into an annulus 316 between aligning tube 147 and connecting tube 200. This annulus extends to the end of the pump section at converging passage body 318 (FIG. 2F).

With reference to FIG. 2F and FIG. 1, the pump end has a nose 24 that seats on standing valve seat 22 that in turn is mounted on a standing valve shoe 20. Nose 24 has external threads threaded into internal threads of coupler 320. Coupler 320 in turn has internal threads engaging external threads of converging passage body 318.

The nose has a passage 322, of which entrance 63 forms a part, that empties into an axially aligned passage 324 of coupler 320. This passage in turn empties into a converging passage 326 defined in converging passage body 318. A passage section 328 within converging passage section body 318 opens into converging passage 326 and empties into pump passage 64 (FIG. 2E). Fluid within pump passage 64 passes through the various pump stages and exits into diffuser passage 65. From this passage, the fluid exits into the annulus outside of the pump through ports 66 and 42 in the diffuser body and coupling 46.

With continued reference to FIGS. 2E and 2F, an O-ring 330 seals the joint between converging passage body 318 and connector tube 200. A nose 332 of converging passage body 318 abuts against a first stage rotor shroud 334 of the pump section. This abutting relationship begins a compressive union of all the shrouds in the pump section. This compressive force is reacted at diffuser body 67. Ultimately, the compressive force is reacted at the turbine end and maintained by tension in the turbine and pump connector tubes 140 and 200 and coupling 46.

With reference to FIG. 2B, at the turbine end of the assembly, turbine diffuser 280 threads into connector tube 140. As seen in FIG. 2C, the diffuser has nose 286 slipped into aligning tube 141 to engage last stage turbine shroud 292. This engagement is compressive and forces all the turbine shrouds tightly up against cleaner housing 48. This engagement complements the similar compressive engagement just described by the pump converging passage piece on the pump shrouds. The axial compressive forces in opposed directions from turbine diffuser 280 and converging passage body 318 at the pump end of the assembly locate and lock the parts. The connector tubes maintain the forces and the lock.

Turbine diffuser 280 has diffuser passage 53 opening into a diffuser passage proper 336. This passage empties into a cylindrical passage 338 formed of a coupler 340. Passage 338 opens into a passage 342 of tube 59. The coupler secures to tube 59 and diffuser body 280 by threads at 344 and 346, respectively. As seen in FIG. 2A, passage 342 is capped by a plug 348 that threads into internal threads at the very end of tube 59. Radial ports 55 provide for the exit of spent turbine fluid. That fluid goes into annulus 56 between collar 58 and tube 59. As can be seen in FIG. 1, this annulus communicates with ports 40 for exiting the spent turbine fluid into the casing outside the collar. The packer collar has a plurality, say four, of generally longitudinal side lines 36. These passages open into tubing string 26 through radial ports 350 in the tubing. An annular channel 352 in collar 58 opens into the radial ports. An O-ring 354 seals against the collar and the tubing string. Collar 58 couples to connector tube 140 at a joint (not shown). Bridgeman seals 356 and 258 (FIG. 2B) on the outside of tube 59 axially bound annulus 56. An O-ring 360 on the inside of collar 58 bears on annular gland 57 which in turn bears on seal 358 to define one axial terminus of the turbine fluid discharge annulus. Bridgeman seal 356 at the other extreme end of the discharge annulus cooperates with a surface of collar 58 to effect a seal at that end.

Plug 348 has a medical flange 362 that stops against tube 59.

As was previously described, each of the pump stators and each of the turbine stators are integrated with shrouds. In the case of the pump stator shrouds and with reference to FIG. 2E, each shroud is provided with an external channel for receiving lubricant such as channel 158 in shroud 162 of second to the last stage stator 154. Because of the assembly technique used in the pump requiring the staking of the rotors to the shaft, the last pump stage stator has its own shroud and the first pump stage rotor has its own shroud while shrouds in between serve for both a rotor and a stator, though of different stages. These terminal shrouds are shown at 150 and 364, the latter being a first stage rotor shroud, and the former a stator shroud. The same obtains at the turbine end.

The shrouds at the turbine end differ from the shrouds at the pump end in the axial slots on their external surfaces and the annular channels that serve to communicate the axial slots. For both the turbines and pump stage shrouds, the aligning tubes immediately receiving the shrouds serve to maintain their concentricity, while the connector tubes, turbine diffuser body, converging passage body, and coupler 46 are tightened to effect the compressive loading of the shrouds and the concomitant axial positioning of the stators, rotors, and drive shaft.

It is believed that the operation of the turbo-machine of the present invention has been described above, but for the convenience of having a continuous description of the operation in one place the following is presented.

The turbo-machine in a well draws well fluid through perforations 14 into tubing 19 by the action of pump stages 32 on the fluid. Turbine stages 30 drive the pump. Power fluid for the turbines comes from the surface of the well and enters the turbine section through side lines 36. The bulk of the power fluid flows through the axial passage of the turbines and drives the turbine's rotors. Spent power fluid exits from the assembly at port 40 after passing through diffuser passage 336 (FIG. 2B) to convert velocity head to static head. The interstage stators of the turbine assembly provide direction for the flowing power stream. Pump well fluid passes through the axial passage in the pump section and incrementally receives a boost in head by each of the pump stage rotors. Interstage stators impart direction to the flowing well fluid. Well fluid has its velocity head decreased in favor of static head in diffuser passage 65 and passes outside the assembly.

The lubricant stream passes into the turbo-machine with the power fluid supply but branches from this supply to enter the centrifugal cleaner 37. The force field of this cleaner is adequate to prevent solid material from entering its interior but inadequate to prevent fluid from entering the interior. This fluid, separated from solids it previously contained, passes into passage 71. From this passage the fluid exits to supply pump stage and turbine stage lubricant. In the pump stage, fluid separates into parallel passages that lead into thrust bearing runner chamber of housing 80 to effect an opposition force to unbalance axial forces acting on the assembly and transmitted through drive shaft 60. This opposition requires a pressure differential across the thrust bearing runner when fluid is flowing past the faces of the runner. This step down in pressure is afforded by orifices in the parallel passages. To assure that discharge pressure from the thrust bearing runner is lower than cleaner discharge pressure, gallery 138 bleeds into an intermediate turbine stage passage when the pressure in the gallery becomes too high. This gallery serves to lubricate the journal and journal bearings of the pump stages and because the pressure within the gallery is always higher than the pressure of the well fluid flowing through the pump stages, positive lubricant flow through the bearings from the gallery results. High pressure lubricant directly from the cleaner feeds the majority of the turbine stage journals.

The present invention has been described with reference to a preferred embodiment. The spirit and scope of the appended claims should not, however, necessarily be limited to the foregoing description.

What is claimed is:

1. In combination with a machine used to do useful work downhole in a well and which is powered by power fluid circulated from the surface of the well, an improvement comprising:

(a) engine means adapted to be driven by the power fluid, the engine means having bearings;

(b) cleaner means driven by the engine means in rotation to separate solids from fluid by centrifugal action;

(c) means to deliver a slip stream of the power fluid to the centrifugal cleaner means for cleaning thereby and the production of a cleansed power fluid slip stream;

(d) lubricant passage means from the centrifugal cleaner for delivering the cleansed power fluid slip stream to bearings of the machine and to lubricate the bearings; and (e) means to deliver the balance of the power fluid to the engine to drive the engine, such delivery means being independent of the delivery means to the cleaner, whereby only a slip stream of power fluid is cleansed of solids downhole while the bulk of the power fluid from which it is derived drives the engine.

2. The improvement claimed in claim 1 wherein the bearing means includes pairs of cooperating bearing surfaces having an interface between each pair of cooperating bearing surfaces, the lubricant passage means from the centrifugal cleaner to the bearings including the interfaces between cooperating bearing surfaces.

3. The improvement claimed in claim 2 including:

(a) power fluid passage means for the power fluid that has been used to drive the engine to deliver the power fluid from the engine, and wherein (b) some of the interfaces open into the power fluid passage means that has been used to drive the engine.

4. The improvement claimed in claim 3 wherein the engine means includes a plurality of turbine stages and the power fluid passage means for the power fluid that has been used to drive the engine includes a portion through the turbine stages.

5. The improvement claimed in claim 4 wherein the machine includes:

(a) at least one pump for pumping well fluid from downhole to the surface and being driven by the turbine stages;

(b) bearings for the pump having pairs of cooperating bearing surfaces, each pair of such cooperating bearing surfaces having an interface between them; and (c) the lubricant passage means includes the interfaces between the bearings of the pump.

6. The improvement claimed in claim 5 wherein:

(a) the pump includes well fluid passage means for the well fluid being pumped; and (b) the interfaces between the bearing of the pump open into such well fluid passage means.

7. In a turbo-machine of the type used downhole in an underground well and having a plurality of stages of turbines and a plurality of stages of axial flow pumps for pumping well fluid driven by the turbines, the pumps being adapted to pump well fluid from downhole to the surface, the pump stages and the turbines stages each having bearing means, an improvement which comprises:

(a) a housing containing the pump stages and the turbine stages;

(b) centrifugal cleaner means within the housing and driven by the turbine stages;

(c) first passage means for delivering power fluid from a stream thereof to the cleaner means, the power fluid originating at the surface of the well;

(d) second passage means to the turbines for power fluid from the surface of the well to drive the turbines, such second passage means bypassing the cleaner means; and (e) third passage means from the cleaner means for providing cleansed fluid as a lubricant to the bearing means of the pump stages and the turbine stages;

whereby power fluid for use with the bearings of the turbo-machine is cleansed of abrasive solids at the downhole location while power fluid used to drive the turbo-machine is not.

8. The improvement claimed in claim 7 including:

(a) a drive shaft coupling the pump stages to the turbine stages to provide the drive of the pump stages by the turbine stages;

(b) a thrust bearing runner secured to the drive shaft, the thrust bearing runner having first and second opposed end faces normal to the axis of the drive shaft;

(c) means defining a chamber in receipt of the thrust bearing runner;

(d) the third passage means including first and second parallel passages into the thrust bearing runner chamber to direct lubricant to the first and second thrust bearing runner faces, respectively;

(e) the third passage means also including discharge passage means from the thrust bearing runner chamber for passing cleansed fluid therefrom;

(f) means preventing the flow of lubricant into the thrust bearing runner chamber to the face of the thrust bearing runner opposite the end from which an unbalanced axial thrust exists while permitting lubricant to be directed to the opposite face of the thrust bearing runner and passing into the discharge passage means of the third passage means to create a lubricant pressure differential across the thrust bearing runner opposing the unbalanced thrust; and (g) the discharge passage means of the third passage providing the bearing means of the pump stages with lubricant.

9. The improvement claimed in claim 8 wherein the discharge passage means exits after the pump bearing means into the wall fluid being pumped.

10. The improvement claimed in claim 9 including means to maintain the pressure in the discharge passage means at a pressure above the well fluid being pumped.

11. The improvement claimed in claim 10 including means to limit maximum pressure in the discharge passage to a pressure lower than power fluid pressure upstream from the cleaner means, such pressure limiting means including means in communication with an intermediate turbine stage so that the discharge receiving passage means pressure does not exceed the pressure in this intermediate stage turbine.

12. The improvement claimed in claim 11 wherein the thrust bearing runner is disposed between the turbine stages and the pump stages.

13. The improvement claimed in claim 8 including first and second pressure reduction means in the first and second passages, respectively, of the third passage means between the cleaner means and the thrust bearing runner, each pressure reduction means reducing the pressure in its associated passage when cleansed fluid flows therein.

14. The improvement claimed in claim 13 wherein the third passage means supplying lubricant to the bearing means of the pump stages exits into the well fluid being pumped after the pump bearing means.

15. The improvement claimed in claim 14 including means to maintain the pressure in the discharge passage means from the thrust bearing runner chamber at a pressure above the well fluid being pumped.

16. The improvement claimed in claim 15 wherein the pressure maintaining means includes means in communication with an intermediate turbine stage so that the discharge receiving passage means does not exceed the pressure in this intermediate stage turbine.

17. The improvement claimed in claim 16 wherein each turbine stage and each pump stage includes a rotor and a stator, each rotor being secured to the drive shaft, and the bearing means for the turbine stages and the pump stages includes journal bearings of each stator of such stages and a journal on the drive shaft associated with each journal bearing.

18. The improvement claimed in claim 17 wherein the third passage means includes the interface between the journal and the journal bearing of each stator and the drive shaft.

19. The improvement claimed in claim 18 wherein the cleaner means includes a centrifugal cleaner having a cylindrical wall concentric to the axis of the drive shaft, a plurality of passages in the wall of the cleaner, a bast at one end of the cleaner supporting the cylindrical wall at that end of the cleaner, and passage means from the inside of the cleaner to the third passage means.

20. The improvement claimed in claim 19 wherein the means for preventing the flow of fluid past the thrust bearing runner includes:

a thrust bearing housing in receipt of the thrust bearing runner and having first and second end walls for engaging the first and second runner faces, respectively, upon an unbalanced axial thrust forcing the runner against one or the other of such walls, the first and second passages opening through the first and second walls, respectively, the first and second end faces of the thrust bearing runner closing the first and second passages upon the thrust bearing runner experiencing an unbalanced axial force that forces one of the runner faces up against its associated end wall.

21. The improvement claimed in claim 20 wherein each end wall has a pair of concentric wear rings with an annular channel between them into which the associated of the first and second parallel passages opens.

22. In an axial turbo-machine of the type used downhole in a petroleum or water well, the turbo-machine having a housing, a plurality of tandemly staged turbines in the housing, a plurality of tandemly stages axial flow pumps in the housing for pumping well fluid through an axial passage of the pump stages to the surface of the well, each turbine stage having a rotor and a stator, each pump stage having a rotor and a stator, a drive shaft driven by the turbines and driving the pump stages, and a thrust bearing runner in the housing attached to the drive shaft for counteracting net thrust forces from the turbine stages and the pump stages acting along the axis of the drive shaft, the thrust bearing runner being capable of moving in response to the net axial thrust forces and having first and second faces normal to the axis of the drive shaft, an improvement which comprises:

(a) a centrifugal cleaner in the housing driven by the turbines;

(b) means to direct a branch stream of a power fluid stream through the centrifugal cleaner and to produce by the cleaner a lubricant stream having a solids content lower than the balance of the power fluid stream;

(c) power fluid passage means to and through the turbine stages for the balance of the power fluid stream to drive the turbine stages;

(d) first and second passage means from the cleaner means opening onto the first and second faces of the thrust bearing runner, respectively;

(e) means for providing flow paths for the lubricant stream past the first and second faces of the thrust bearing runner;

(f) means blocking the flow path for the lubricant stream past the first runner face when the thrust bearing runner responds to net axial thrust forces acting upon the runner that move the first runner face toward the first passage means from the cleaner;

(g) means blocking the flow path for the lubricant stream past the second runner face when the thrust bearing runner responds to net axial thrust forces acting upon the runner that move the second runner face toward the second passage means from the cleaner.

(h) a journal bearing for each of the turbine stages between each stator thereof and the drive shaft, each journal bearing journaling the drive shaft;

(i) a journal bearing for each of the pump stages between each stator thereof and the drive shaft, each journal bearing journaling the drive shaft;

(j) gallery means receiving the lubricant from the flow paths past the faces of the thrust bearing runner;

(k) passage means from the gallery means to provide lubricant to each of the journal bearings of the pump stages; and (l) passage means from the cleaner to provide lubricant to at least some of the journal bearings of the turbine stages.

23. The improvement claimed in claim 22 wherein the journal bearings of the pump stages open into the pump stages axial passage for exiting lubricant fluid into well fluid.

24. The improvement claimed in claim 23 wherein the journal bearings of the turbine stages open into the passage means through the turbine stages for exiting lubricant fluid into the power fluid used to drive the turbines.

25. The improvement claimed in claim 23 including means for pressure communicating the gallery means with the power fluid passage of an intermediate of the turbine stages to establish gallery pressure and the pressure of the first and second passage means.

26. The improvement claimed in claim 25 wherein the pressure communication means includes check valve means between the gallery means and the intermediate turbine stage power fluid passage.

27. The improvement claimed in claim 24 wherein the turbine stages include a plurality of tandemly aligned shrouds for the rotors and stators of the turbine stages, an alignment tube securing the shrouds of the turbine stages and being received in the housing, at least one axial passage for each shroud bounded by the outside of each shroud and the aligning tube, and annular channels between the shrouds communicating the axial passages of the shrouds.

28. The improvement claimed in claim 27 wherein the pump stages include a plurality of tandemly aligned shrouds for the rotors and stators of the pump stages, an alignment tube receiving the shrouds of che pump stages and being received in the housing, the passage means from the gallery to provide lubricant to each of the journal bearings of the pump stages includes radial passages through the shrouds of the pump stages and the pump stage alignment tube to such journal bearings.

29. The improvement claimed in claim 25 wherein the turbine stages include a plurality of tandemly aligned shrouds for the rotors and stators of the turbine stages, an alignment tube securing the shrouds of the turbine stages and being received in the housing, at least one axial passage for each shroud bounded by the outside of each shroud and the aligning tube, and annular channels between the shrouds communicating the axial passages of the shrouds.

30. The improvement claimed in claim 29 wherein the pump stages include a plurality of tandemly aligned shrouds for the rotors and stators of the pump stages, an alignment tube receiving the shrouds of the pump stages and being received in the housing, the passage means from the gallery to provide lubricant to each of the journal bearings of the pump stages includes radial passages through the shrouds of the pump stages and the pump stage alignment tube to such journal bearings.

31. In an axial turbo-machine of the type used downhole in a petroleum or water well, the turbo-machine having a housing, a turbine section including a plurality of tandemly staged turbines in the housing, a pump section including a plurality of tandemly staged axial flow pumps in the housing for pumping well fluid through an axial passage of the pump stages to the surface of the well, each turbine stage having a rotor and a stator, each pump stage having a rotor and a stator, a plurality of tandemly aligned pump section shrouds receiving the rotors and stators of the pump stages, a pump section alignment tube receiving and concentrically aligning the pump stage shrouds, a plurality of tandemly aligned turbine section shrouds receiving the rotors and stators of the turbine stages, a turbine section alignment tube receiving and concentrically aligning the turbine stage shrouds, the housing receiving the pump section alignment tube and the turbine section alignment tube, a drive shaft driven by the turbines and driving the pump stages, a thrust bearing chamber in the housing, and a thrust bearing runner in the chamber and attached to the drive shaft for counteracting net axial thrust forces from the turbine stages and the pump stages acting along the axis of the drive shaft, the thrust bearing runner being capable of moving in response to the net axial thrust forces and having first and second faces normal to the axis of the drive shaft, an improvement which comprises:

(a) a centrifugal cleaner in the housing driven by the turbines through the drive shaft;

(b) means to direct a branch stream of a power fluid stream through the centrifugal cleaner and to produce by the cleaner a lubricant stream having a solids content lower than the balance of the power fluid stream;

(c) means for providing power fluid passage means to and through the turbine stages for the balance of the power fluid stream to drive the turbine stages;

(d) means for providing first and second passage means from the cleaner means into the chamber and opening onto the first and second faces of the thrust bearing runner, respectively;

(e) means for providing flow paths for the lubricant stream past the first and second faces of the thrust bearing runner;

(f) means blocking the flow path for the lubricant stream past the first runner face when the thrust bearing runner responds to net axial thrust forces acting upon the runner that move the first runner face toward the first passage means from the cleaner;

(g) means blocking the flow path for the lubricant stream past the second runner face when the thrust bearing runner responds to net axial thrust forces acting upon the runner that move the second runner face toward the second passage means from the cleaner;

(h) a journal bearing for each of the turbine stages between each stator thereof and the drive shaft, each journal bearing journaling the drive shaft;

(i) a journal bearing for each of the pump stages between each stator thereof and the drive shaft, each journal bearing journaling the drive shaft;

(j) gallery means receiving the lubricant from the flow paths past the faces of the thrust bearing runner;

(k) passage means from the gallery to provide lubricant to each of the journal bearings of the pump stages; and (l) means for providing passage means from the cleaner to provide lubricant to at least some of the journal bearings of the turbine stages.

32. The improvement claimed in claim 31 wherein the journal bearings of the pump stages open into the pump stages axial passage for exiting lubricant fluid into well fluid.

33. The improvement claimed in claim 32 wherein the journal bearings of the turbine stages open into the passage means through the turbine stages for exiting lubricant fluid into the power fluid used to drive the turbines.

34. The improvement claimed in claim 32 including means for pressure communicating the gallery means with the power fluid passage of an intermediate of the turbine stages to establish gallery pressure and the pressure of the first and second passage means.

35. The improvement claimed in claim 34 wherein the pressure communication means includes check valve means between the gallery means and the intermediate turbine stage power fluid passage.

36. The improvement claimed in claim 35 wherein the turbine section includes at least one axial passage for each turbine section shroud bounded by the outside of each such shroud and the turbine section aligning tube, and annular channels between such shrouds communicating the axial passages of such shrouds.

37. The improvement claimed in claim 36 wherein the passage means from the gallery means to provide lubricant to each of the journal bearings of the pump stages includes radial passages through the pump section shrouds and the pump section alignment tube to such journal bearings.

38. The improvement claimed in claim 34 wherein the housing includes a turbine section connector tube receiving the turbine section alignment tube, a pump section connector tube receiving the pump section alignment tube, a coupler attaching the turbine section alignment tube and the pump section alignment tube, means on the pump section compressively loading the pump section shrouds, means on the turbine section compressively loading the turbine section shrouds, and the connector tubes and coupler reacting and maintaining the compressive loads.

39. The improvement claimed in claim 37 wherein the housing includes a turbine section connector tube receiving the turbine section alignment tube, a pump section connector tube receiving the pump section alignment tube, a coupler attaching the turbine section alignment tube and the pump section alignment tube, means on the pump section compressively loading the pump section shrouds, means on the turbine section compressively loading the turbine section shrouds, and the connector tubes and coupler reacting and maintaining the compressive loads.

* * * * *

UNITED STATES PATENT AND TRADEMARK OFFICE

CERTIFICATE OF CORRECTION

PATENT NO. : 4,264,285

DATED : April 28, 1981

INVENTOR(S) : John W. Erickson
Harold L. Petrie

It is certified that error appears in the above-identified patent and that said Letters Patent are hereby corrected as shown below:

In the specification: Column 7, line 14, "72" should be --74--; Column 13, line 24, "258" should be --358--; Column 13, line 32, "medical" should be --medial--.

In the claims: Claim 9, column 16, line 29, "wall" should be --well--; Claim 19, column 17, line 10, "bast" should be --base--; Claim 22, column 17, line 36, "stages" should be --staged--; Claim 22, column 18, line 9, the period "." should be a semicolon --;--.

Signed and Sealed this

*Twenty-ninth* Day of *September 1981*

[SEAL]

*Attest:*

GERALD J. MOSSINGHOFF

*Attesting Officer*

*Commissioner of Patents and Trademarks*